United States Patent [19]

Fillmore

[11] 3,980,195

[45] Sept. 14, 1976

[54] TAMPER-PROOF CLOSURE

[75] Inventor: William E. Fillmore, Sylvania, Ohio

[73] Assignee: Owens-Illinois, Inc., Toledo, Ohio

[22] Filed: Nov. 18, 1974

[21] Appl. No.: 524,386

[52] U.S. Cl. ..... 215/256; 215/252; 215/276; 215/330

[51] Int. Cl.[2] ..... B65D 41/32

[58] Field of Search ..... 215/256, 249, 330, 251, 215/252, 247, 276, 277

[56] References Cited

UNITED STATES PATENTS

| | | | |
|---|---|---|---|
| 3,812,994 | 5/1974 | Feldman | 215/256 |
| 3,871,545 | 3/1975 | Bereziat | 215/256 |
| 3,901,404 | 8/1975 | Feldman | 215/256 |

*Primary Examiner*—R. E. Hart

*Attorney, Agent, or Firm*—A. J. Steger; E. J. Holler

[57] ABSTRACT

A tamper-proof closure, for a container, which requires removal of a tamper-proof ring before the container may be opened. The closure of the present invention includes a closure body which is threadably engaged with the finish portion of a container. A split tamper-proof ring is attached to the closure body at a plurality of severable locations at the root portion of a plurality of projections formed on the interior of the tamper-proof ring. A severable bridge extends between the opposed free ends of the split tamper-proof ring and connects them. The container has a series of external projections located below the threads of the finish portion. The projections of the tamper-proof ring lock with the projections on the container to prevent removal of the closure body. To remove the closure, the severable bridge is broken and the resulting free end of the tamper-proof ring is used as a pull tab to break the connections between the closure body and the tamper-proof ring.

2 Claims, 6 Drawing Figures

TAMPER-PROOF CLOSURE

BACKGROUND OF THE INVENTION

This invention generally relates to tamper-proof closures for containers. Specifically, this invention relates to tamper-proof closures of the type requiring physical removal of a tamper-proof ring from the container before the container can be opened.

Tamper-proof closures of this general type may be seen in the following U.S. Pat. Nos. 3,249,247; 3,504,818; 3,650,428 and 3,812,994. Of the general types shown, the type which requires removal of a tamper-proof band or ring from a container before the container can be unsealed is one specific example. A problem with this specific type of closure is making provision for a pull tab or ring to allow severing of the tamper-proof ring from the main body of the closure. The prior art shows a number of such pull tabs, attached to the tamper-proof ring, which extend radially outwardly from the tamper-proof ring itself. This is undesirable because such pull tabs can become entangled with one another or can accidentally be hooked and partially removed before the ultimate consumer receives the package. I have solved this problem by making the tamper-proof ring in the form of a split ring and connecting the free ends of the split ring with a severable bridge that lies between the ends. When the bridge is severed or broken, one of the ends of the split ring is then exposed and may be used as a pull tab to completely remove the tamper-proof ring.

SUMMARY OF THE INVENTION

My invention is a tamper-proof closure for a container. The container includes an externally threaded finish portion terminating in an annular rim defining an opening into the container. The container further includes a plurality of circumferentially spaced-apart projections located below and adjacent to the finish threads. The closure itself includes a closure body having internal threads that will engage with the threads on the container finish. A main sealing ring is attached to the inner surface of the closure body and depends downwardly therefrom. The main sealing ring is designed to enter the container opening and engage the inner surface of the container opening. A split tamper-proof ring has a plurality of internal projections which cooperate with the container external projections to define a one-way ratchet drive to prevent removal of the closure once the internal and external projections are engaged. The tamper-proof ring is severably connected to the closure body only at a root portion of each of the internal projections. A severable bridge connects the opposed ends of the split tamper-proof ring. The severable bridge is positioned between the two opposed ends.

DETAILED DESCRIPTION OF THE DRAWINGS

Figure 1:
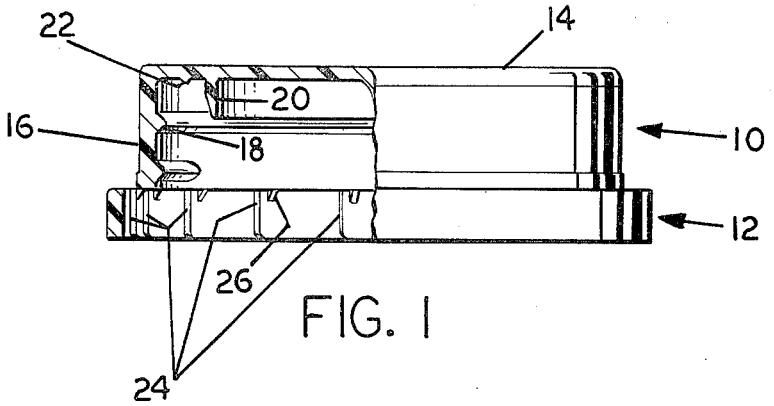
FIG. 1 is a side, elevational view, partially in cross-section, of the tamper-proof closure of the present invention.
Figure 2:
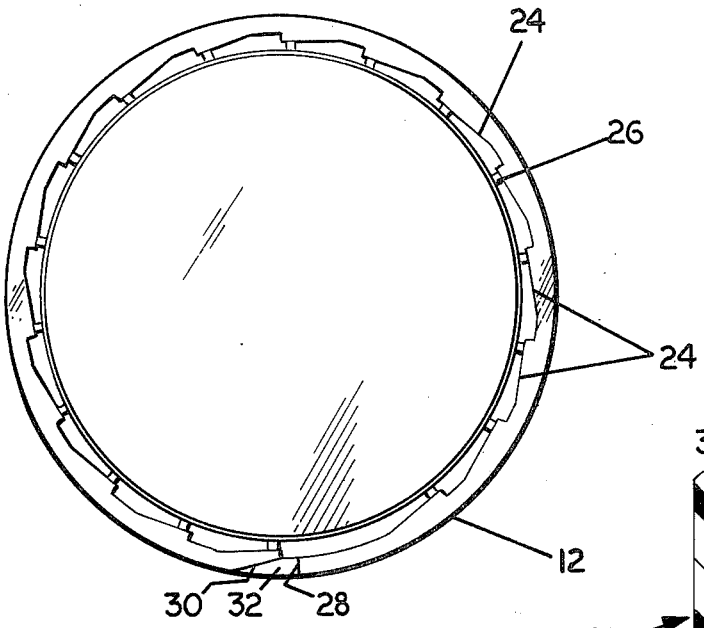
FIG. 2 is a top, plan view of the closure of FIG. 1.

FIGS. 1 and 2 illustrate the tamper-proof closure of the present invention. The tamper-proof closure is made up of two primary members; a closure body 10 and a split tamper-proof ring 12. The closure body 10 includes a circular top panel 14 and a depending annular skirt 16 integrally formed therewith. The interior of the depending skirt 16 has threads 18 formed therein. Depending from the interior of the top panel 14 is an annular main sealing ring 20. Spaced radially outwardly therefrom is a much shorter, annular, secondary sealing bead 22. The split tamper-proof ring 12 is formed with a plurality of internal projections or teeth 24. The tamper-proof ring 12 is connected to the main closure body 10 by a severable connection 26 that connects only the root portion of the projections 24 to the main body 10. In the specific example illustrated in FIGS. 1 and 2, there are seventeen projections 24 and correspondingly seventeen severable connections 26. By virtue of being a split ring, the split tamper-proof ring 12 has two opposed free ends 28 and 30. These two opposed ends 28 and 30 are connected together by a severable bridge 32. Note that the severable bridge 32 is positioned between the ends 28 and 30 and does not project beyond the radial dimension of the tamper-proof ring 12. Because of the number of severable connections 26 which hold the split tamper-proof ring 12 to the closure body 10, this particular tamper-proof closure cannot be removed from a container by simply twisting the closure body 10 as can some types of tamper-proof closures in the prior art. Rather, the tamper-proof ring 12 must be at least partially removed before the closure body 10 can be removed from a container. However, other such devices in the prior art had attached thereto a pull tab which extended beyond the radius of the tamper-proof ring 12 itself. This was undesirable in that this projection would possibly become entangled with similar projections from other closures when the containers were in mass configuration. Likewise, by having the pull tab or the tamper-proof ring extending beyond the tamper-proof ring, it was possible to snag or catch this ring on projections and remove it before it had passed into the hands of the ultimate consumer, who normally would remove the tamper-proof ring. The closure of the present invention overcomes this problem by positioning the severable bridge 32 between the two ends 28 and 30 of the tamper-proof ring 12. By breaking the bridge 32, the end 28 of the tamper-proof ring 12 becomes free, and the ultimate consumer may use this portion of the tamper-proof ring 12 as a pull tab to break the severable connections 26 and thus remove the entire tamper-proof ring 12.

Figure 3:
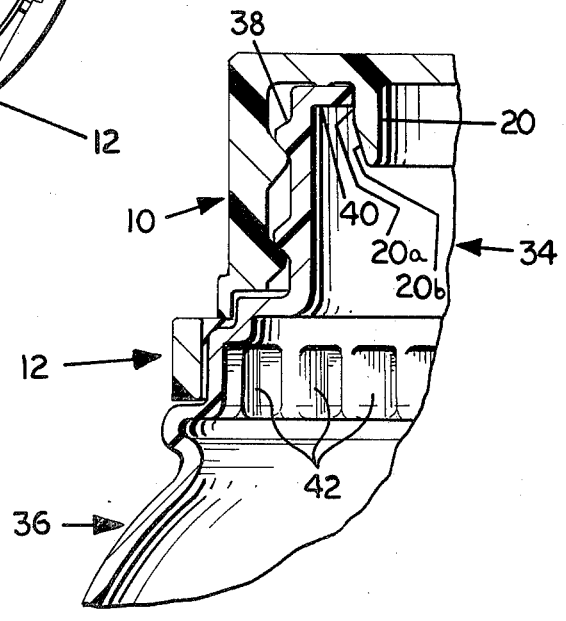
FIG. 3 is a side, elevational view, partially in cross-section, of the closure of the present invention in place on a container.

In FIG. 3, the tamper-proof closure of the present invention is shown in position on the finish portion 34 of a container 36. The finish portion 34 includes external threads 38 which threadably engage the threads 18 formed in the closure body 10, an annular rim portion 40 which defines an opening into the container 36, and a plurality of circumferentially located, spaced-apart projections 42 which are located below the threaded portion 38 of the finish 34. The projections 42 are not necessarily continuously spaced about the entire circumference; the projections may be in two or more groups of five or ten projections 42 with blank spaces between the groups. The projections 42 on the container 36 engage the projections 24 on the interior of the split tamper-proof ring 12 and lock the entire closure onto the container finish 34. It should be apparent that the projections 24 and 42 cooperate to form a type of one-way ratchet drive. That is, the tamper-proof closure of this invention may be threaded onto a container 36, but it may not be removed until the tamper-proof ring 12 has been removed from the container 36. As was previously noted, the number of severable connections 26 which hold the tamper-proof ring 12 onto the main closure body 10 make it extremely difficult to apply enough torque to the closure body 10 to take it off of the container finish 34 by simply twisting the severable connections 26. Rather, as previously noted, it is necessary to break the bridge 32 and use the portion of the tamper-proof ring 12 which then becomes available to tear the severable connections 26 free from the closure body 10. Also note in FIG. 3 that the main sealing ring 20 extends into the opening in the finish 34 of the container and engages the interior surface of the annular rim 40. Observe that the main sealing ring 20 has a cylindrical portion 20*a* which actually engages the rim 40 interior. The main sealing ring 20 also includes a tapered or conical portion 20*b* which actually enters the finish opening. The conical portion 20*b* insures positive and true entry of the main sealing ring 20 into the finish opening. This engagement provides the primary seal which prevents escape of the contents of the container 36. It is particularly desirable to provide this primary seal at this point in a container 36 which is particularly adapted to contain fluids. If the primary seal were provided at a different location, for example, below the threads 38 and 18, it would be possible for liquid to leak around the threads and thus form an undesirable film on the threads themselves. In addition, a secondary seal is obtained by contact of the secondary sealing bead 22 with the upper surface of the rim 40. This provides a further assurance that there will be no leakage of liquid contents of the container 36 into the threaded areas.

Figure 4:
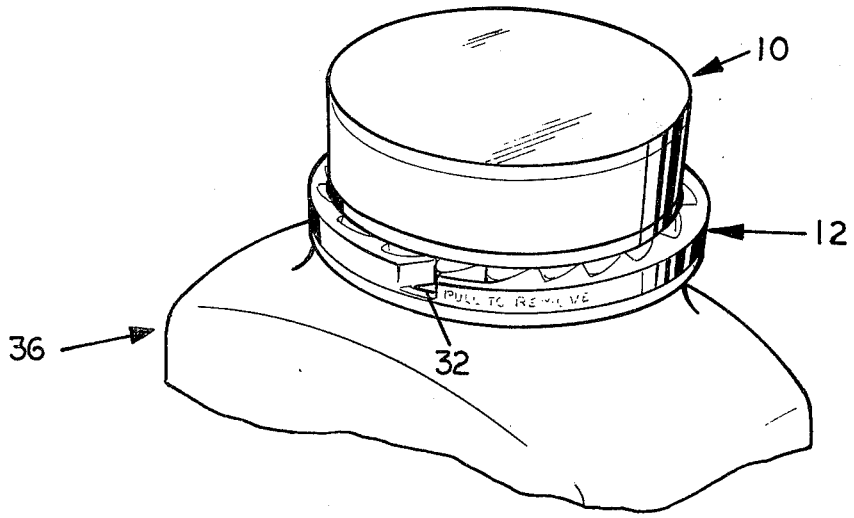
FIG. 4 is a perspective view of a closure of the present invention as applied to a container.
Figure 5:
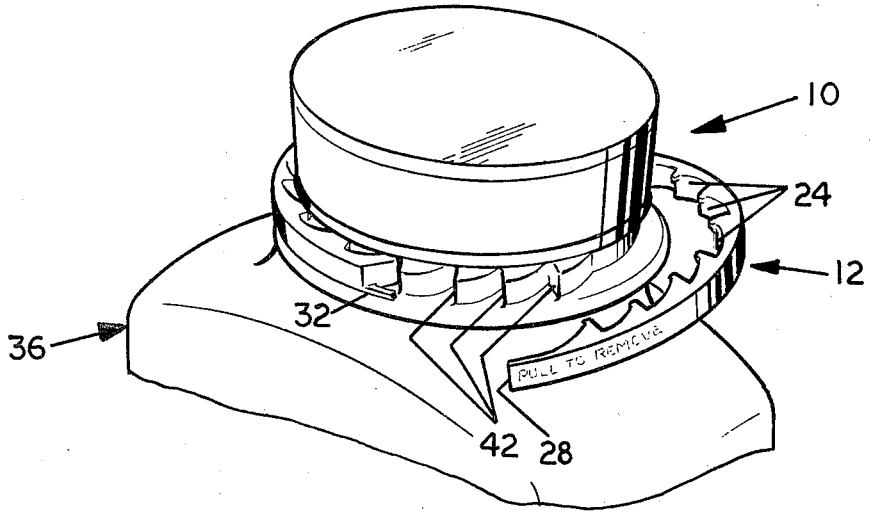
FIG. 5 is the view of FIG. 4 showing the tamper-proof ring partially removed.
Figure 6:
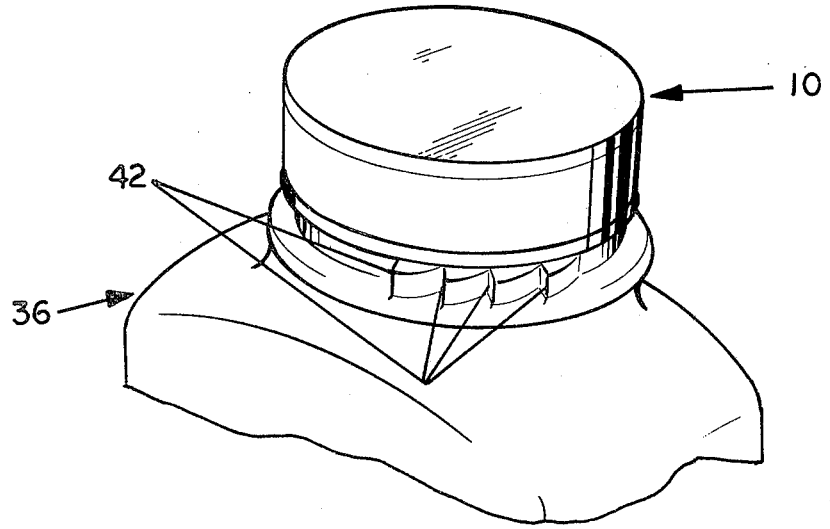
FIG. 6 is the view of FIG. 4 showing the tamper-proof ring completely removed.

FIGS. 4, 5 and 6 illustrate the application of the tamper-proof closure of the present invention to a container and removal therefrom. In FIG. 4, the tamper-proof closure of the present invention is seen, as it would normally be received by a consumer, attached to the finish of a container 36. Note that the bridge 32 is clearly visible in FIG. 4 and that a legend is printed on the split tamper-proof ring 12 to instruct the consumer as to how the tamper-proof ring 12 should be removed. In FIG. 5, the severable bridge 32 has been broken and the end 28 of the tamper-proof ring 12 has been partially pulled away. This motion then breaks the severable connections 26 which hold the tamper-proof ring 12 to the closure body 10. Also in FIG. 5 it will be noted that the projections 42 on the finish of the container 36 have become visible as have the projections 24 formed on the interior of the split tamper-proof ring 12. In FIG. 6, the tamper-proof ring 12 has been completely removed from the finish of the container 36. In this configuration, the closure body 10 may be threaded off of the finish portion of the container 36 to allow access to the contents thereof. The use of the tamper-proof ring 12 provides a positive assurance to the ultimate consumer of the products within the container 36 that the container 36 has not been previously opened before it is used by the consumer. Some types of tamper-proof rings are constructed such that the closure body is simply twisted to break the connection between the two elements. This may, in some cases, allow the tamper-proof ring to drop down so that there is also a ready indication that the seal has been broken. In other cases, the tamper-proof ring simply remains in position and it would be possible to thread the closure body back onto the container finish to such a position that the casual observer might not realize that the container had been previously opened. By positively removing the tamper-proof ring 12 from the container 36 before the closure body 10 may be removed therefrom, a very clear indication of breaking the seal on the container 36 is made.

I claim:

1. A tamper-proof closure for a container having an externally threaded finish portion terminating in an annular rim defining an opening into said container, said container further including a plurality of circumferentially spaced-apart projections located below and adjacent to said finish threads, which comprises, in combination:

a closure body having internal threads for cooperative threadable engagement with said threaded finish;

a main sealing ring, attached to the inner surface of said closure body and depending downwardly therefrom, for entry into said container opening and engagement with the inner surface thereof;

a split, discontinuous, tamper-proof ring having a plurality of internal projections for cooperation with said container external projections to thereby define a one-way ratchet drive to prevent removal of said closure once said internal and external projections are engaged, said split, discontinuous tamper-proof ring terminating in two opposed facing free ends, said tamper-proof ring being severably connected to said closure body only at a root portion of said each of said internal projections; and a severable bridge connecting the opposed ends of said split tamper-proof ring and being positioned between said opposed ends, said severable bridge lying completely radially inward of the outer most radius of said tamper-proof ring.

2. The closure of claim 1 which further includes:

an annular, secondary sealing bead, attached to the inner surface of said closure body and depending downwardly therefrom, said secondary sealing bead being spaced radially outwardly from said main sealing ring and positioned to abut said finish rim upper surface when said closure is placed on said container.

* * * * *